US010950401B2

(12) United States Patent
Hierl

(10) Patent No.: US 10,950,401 B2
(45) Date of Patent: Mar. 16, 2021

(54) THERMALLY TRIGGERED, MECHANICAL SWITCHING DEVICE

(71) Applicant: DEHN SE + CO KG, Neumarkt/Opf. (DE)

(72) Inventor: Stephan Hierl, Neumarkt (DE)

(73) Assignee: DEHN SE + CO KG, Neumarkt/Opf. (DE)

( * ) Notice: Subject to any disclaimer, the term of this patent is extended or adjusted under 35 U.S.C. 154(b) by 0 days.

(21) Appl. No.: 16/490,793

(22) PCT Filed: Mar. 5, 2018

(86) PCT No.: PCT/EP2018/055276
§ 371 (c)(1),
(2) Date: Sep. 3, 2019

(87) PCT Pub. No.: WO2018/166825
PCT Pub. Date: Sep. 20, 2018

(65) Prior Publication Data

US 2020/0013572 A1 Jan. 9, 2020

(30) Foreign Application Priority Data

Mar. 14, 2017 (DE) ..... 102017105436.7

(51) Int. Cl.
*H01H 37/76* (2006.01)
*H01H 71/18* (2006.01)

(52) U.S. Cl.
CPC ..... *H01H 37/76* (2013.01); *H01H 37/764* (2013.01); *H01H 37/765* (2013.01);
(Continued)

(58) Field of Classification Search
CPC .. H01H 37/76; H01H 2037/762; H01H 71/18; H01H 35/38; H01H 37/44;
(Continued)

(56) References Cited

U.S. PATENT DOCUMENTS 4,032,877 A * 6/1977 McAlister ..... H01H 37/761 337/148
4,109,229 A * 8/1978 Plasko ..... H01H 37/765 337/408

(Continued)

FOREIGN PATENT DOCUMENTS

DE 495893 4/1930
DE 2349019 A1 4/1975

(Continued)

OTHER PUBLICATIONS

An Office Action (in German), dated Oct. 26, 2017, issued by the German Patent Office for Applicant's corresponding German Patent Application No. DE102017105436.7, filed Mar. 14, 2017.

(Continued)

*Primary Examiner* — Jayprakash N Gandhi
*Assistant Examiner* — Stephen S Sul
(74) *Attorney, Agent, or Firm* — Bodner & O'Rourke, LLP; Gerald T. Bodner; Christian P. Bodner

(57) ABSTRACT

The invention relates to a thermally triggered, mechanical switching device, consisting of a heat-sensitive means and a mechanical force-storage means, wherein the heat-sensitive means blocks or unblocks the movement path of a switching piece; furthermore, the switching piece is preloaded and held by the mechanical force-storage means, and comprising a housing that accommodates the aforementioned means. According to the invention, the housing is designed as a cartridge-shaped shell which receives a plunger in the interior thereof, which plunger is mounted in a movable manner through a first end-side opening in the housing and is supported against a fusible shaping part under pretension, wherein the fusible shaping part is arranged so as to cover a second opening, which is located opposite the first end-side opening, in such a way that, when the melting temperature of the fusible shaping part is reached, said fusible
(Continued)

shaping part is displaced by the plunger and the plunger takes on a changed position.

10 Claims, 6 Drawing Sheets

(52) U.S. Cl.
CPC ..... *H01H 71/18* (2013.01); *H01H 2037/762* (2013.01); *H01H 2037/769* (2013.01)

(58) Field of Classification Search
CPC .... H01H 37/765; H01H 43/28; H01H 37/764; H01H 2037/769
USPC ..... 337/409
See application file for complete search history.

(56) References Cited

U.S. PATENT DOCUMENTS 4,275,432 A * 6/1981 Napiorkowski ..... H01T 1/14 337/32
4,281,309 A * 7/1981 Olson ..... H01H 37/765 29/623
4,630,023 A * 12/1986 Gawron ..... H01H 37/765 337/401
7,362,208 B2 * 4/2008 Yoshikawa ..... H01H 37/765 337/388
2003/0196609 A1 10/2003 Stretch et al. ..... 122/17.1
2009/0302990 A1 * 12/2009 Neilly ..... H01H 37/60 337/312
2010/0219929 A1 * 9/2010 Lee ..... H01H 37/765 337/182
2011/0073420 A1 * 3/2011 Nagel ..... B60T 17/22 188/152
2016/0042905 A1 * 2/2016 Xu ..... H01H 85/36 337/148
2016/0336136 A1 * 11/2016 Kim ..... H01H 37/765
2017/0345602 A1 * 11/2017 Yoon ..... H01H 85/06

FOREIGN PATENT DOCUMENTS

DE 9017534 U1 3/1991
DE 19619100 A1 11/1997
EP 0126107 A1 11/1984
EP 0126107 B1 10/1988

OTHER PUBLICATIONS

The Notification Concerning Transmittal of International Preliminary Report on Patentability (Chapter I of the Patent Cooperation Treaty), in English, dated Sep. 26, 2019, which was issued by the International Bureau of WIPO in Applicant's corresponding international PCT application having Serial No. PCT/EP2018/055276, filed on Mar. 5, 2018.

The English translation of the International Preliminary Report on Patentability (Chapter I of the Patent Cooperation Treaty), dated Sep. 17, 2019, which was issued by the International Bureau of WIPO in Applicant's corresponding international PCT application having Serial No. PCT/EP2018/055276, filed on Mar. 5, 2018.

The Written Opinion of the International Searching Authority, in English, dated May 17, 2018, which was issued by the International Bureau of WIPO in Applicant's corresponding international PCT application having Serial No. PCT/EP2018/055276, filed on Mar. 5, 2018.

The International Search Report, in English, dated May 17, 2018, which was issued by the International Bureau of WIPO in Applicant's corresponding international PCT application having Serial No. PCT/EP2018/055276, filed on Mar. 5, 2018.

* cited by examiner

THERMALLY TRIGGERED, MECHANICAL SWITCHING DEVICE

The invention relates to a thermally triggered, mechanical switching device, consisting of a heat-sensitive means and a mechanical force-storage means, wherein the heat-sensitive means blocks or unblocks the movement path of a switching piece; furthermore, the switching piece is preloaded by the mechanical force-storage means, and comprising a housing that accommodates the aforementioned means according to claim 1.

From DE 1753DAZ an electrical self-acting switch is known, which has a heat-sensitive member as a triggering element. With the aforementioned switch, a switching piece under the impact of a mechanical force-storage means is fastened in its switch position via a frictional connection.

The heat-sensitive member is embodied in the form of a longitudinally recessed bimetal tube and provides one of the two parts that are in frictional connection with each other.

In one embodiment, the longitudinally recessed bimetal tube is in direct frictional connection with a rod-like body, the direct frictional connection acting between the bimetal tube and the rod-body, wherein one of the two parts is stationary but the other part is movably arranged. In this respect, the longitudinally recessed bimetal tube can be provided, in an enclosing manner, on a movable switching piece that is solid or formed as a tube. When heated, the bimetal tube expands and will release the switching piece for the switching movement. In order to be able to adjust the triggering characteristics of the known switching device there is the option of changing the cross-section or the length of a heating coil locally provided. Alternatively, the wall thickness of the bimetal tube can be changed. In one exemplary embodiment of the switching device, telephone fuse plugs are mentioned, where a switching pin is secured by an eutectic solder. In a cold, solidified state, the eutectic solder adheres to the inner walls of the plug housing as well as to the switching pin, whereby the pin is blocked against the effect of a switching spring. In the event of over-current, the eutectic solder melts and releases the adhesion. Thus, the switching pin is pulled out of its blocking position and releases a local contact finger.

According to DE 23 49 019 A1, assemblies for detecting a lack of operability of vacuum switching vessels are state of the art. In this respect, a device reacting to a higher temperature is provided, the device being in a heat-conductive connection with a part of the vacuum switching vessel having a low temperature-time constant, wherein the device controls a signal device and/or the coming into effect of a protection device.

The device provided for detecting the higher temperature is, for example, attached to the casing or to one of the rack pins of switching pieces as a temperature-dependent electrical component. In an advantageous embodiment, the device reacting to a higher temperature is located in a bore of one of the racks of the switching pieces of the vacuum switching vessel. According to the known solution, a fusible solder and a plunger, which is held by means of the fusible solder and is spring-loaded, are used as a temperature-dependent device, wherein the plunger is connected with a switching contact. When an appropriate melting point of the solder is selected, the plunger is released, if the switching pieces warm up inadmissibly.

The known devices and switching devices have in common that they consist of a larger number of individual parts, each of which are to be constructed with respect to the defined case of application and operation.

The large number of components as well as the individual adaptation and construction further leads to a high assembly effort, wherein at the same time the vulnerability to failures of correspondingly realized switching devices increases.

In light of the above, it is thus an object of the invention to provide an advanced, thermally triggered, mechanical switching device, consisting of a heat-sensitive means and a mechanical force-storage means, which requires a minimum number of components and is universally applicable as a practically prefabricated component. At the same time, the switching device to be provided is to be adequate for the application in the context of an automatable production of electrotechnical or electronical components, in which temperature-dependent switching states have to be triggered. The switching states may be an electrical activation as well as a mechanical status indication.

The solution to the object of the invention is achieved via the combination of features according to claim 1, wherein the dependent claims at least include expedient configurations and advancements.

According to the state of the art described above, a thermally triggered, mechanical switching devices is therefore presupposed.

The mechanical switching device includes a heat-sensitive material and a mechanical force-storage means, for example designed as a spring-load means.

The heat-sensitive material blocks the movement path of a switching piece or unblocks such a movement path. Further, the switching piece is preloaded by the mechanical force-storage means. The aforementioned assemblies or components are enclosed by a common housing accommodating the components.

According to the invention, the housing is designed as a cartridge-shaped shell in a cylindrical shape.

The interior of the cartridge-shaped shell is provided with a plunger, which is mounted in a moveable manner through a first end-side opening in the housing and is supported against a fusible shaping part, which is also located within the housing respectively the shell, under pretension.

The fusible shaping part is arranged so as to cover a second opening, which is located opposite the first end-side opening, in such a way that, when the melting temperature of the fusible shaping part is reached, said fusible shaping part is displaced by the plunger. As a result of this displacement process, the plunger can take on a changed position and trigger, for example, a mechanical status indication or an electrical switching device.

The plunger within the shell is enclosed by a collar or has a flange for this purpose, on which a coil spring as a force-storage means is supported.

The shell has a tapered portion with a reduced diameter in a direction of the first opening, which on one side merges into the mentioned first opening and on another side provides a further stop collar for the coil spring on the inner side.

Instead of the tapered diameter, of course, also a nose-shaped lug or the like can be formed on an inner-circumferential side, in order to create a stop collar for the compression spring or the coil spring.

In one configuration of the invention, after the displacement of the fusible shaping part, the plunger penetrates the second opening in such a way that the respective plunger end emerges from the opening and is able to trigger an electrical or a mechanical indication or switching device, practically as an triggering or releasing element.

In a preferred embodiment the fusible shaping part is designed as a plug with respect to the second opening located inside the shell, which opening the plug closes.

Through the movement of the plunger with respect to its position to the first and/or second opening an external switching mechanism can be triggered, as has been explained before. Insofar, the plunger can trigger an electrical switch directly or indirectly, or can trigger a switching status indicator directly or indirectly.

Preferably, the shell is made of a thermally conductive material, wherein the device's response behaviour is settable or adjustable via the thermal capacity of the shell in conjunction with the material of the fusible shaping part.

Preferably, the fusible shaping part is made of an electrically conductive solder material.

The solder material displaced from the second opening can further directly cause an electrical switching mechanism, for example, by bridging an assembly of contact elements.

Hereinafter, the invention is to be elucidated on the basis of an exemplary embodiment and utilizing drawings.

Herein:

FIG. 1 shows an illustration of the thermally triggered, mechanical switching device in a longitudinal section, having a plunger that is provided within a shell along with a preloading compression spring and a solder shaping part as fusible shaping part, wherein the end of the shell that is remote from the plunger is not yet crimped for fixing the solder shaping part while releasing a second opening;

Figure 5:
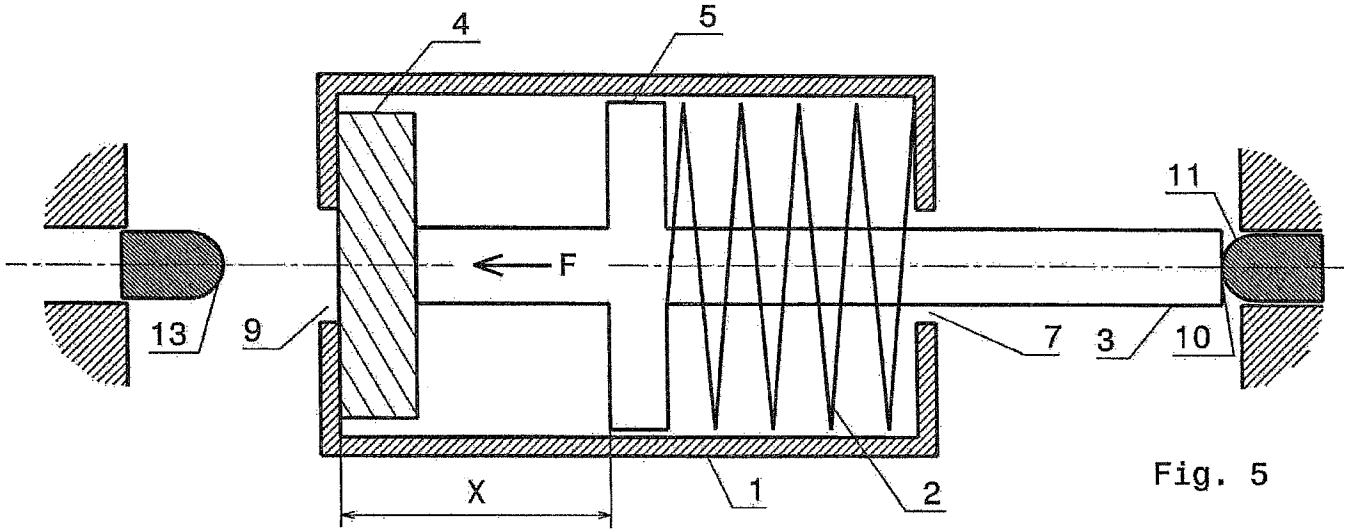
Figure 6:
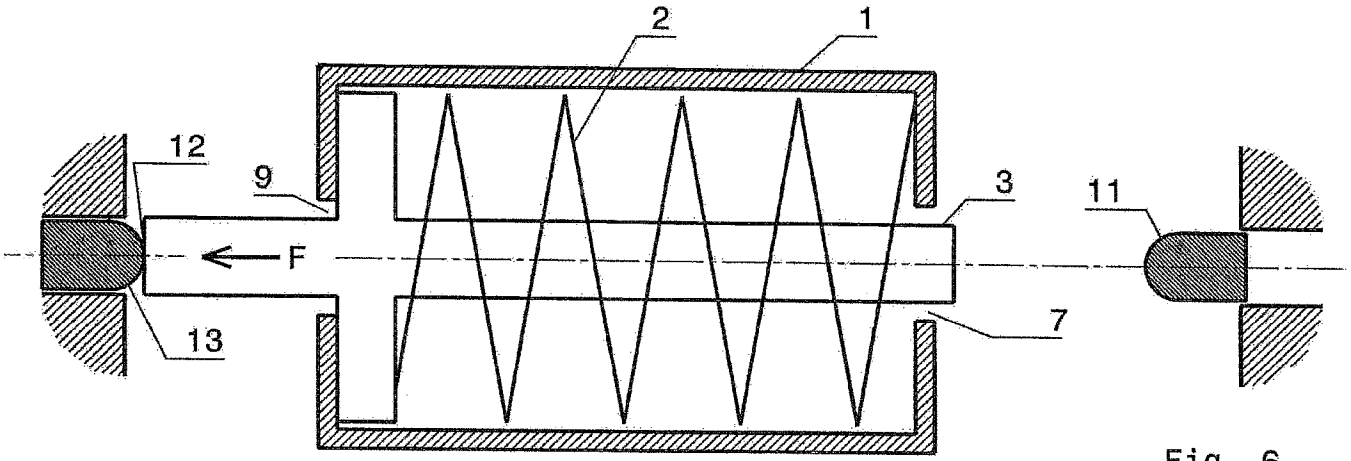

FIG. 5 shows a schematic diagram of the switching device according to the invention in a longitudinal section with a shell-like housing, plunger, spring-load means and peripheral contact or indication elements in a state of a not released switching device; and FIG. 6 shows an illustration similar to that of FIG. 5, but in a state after fusing of the fusible shaping part and displacing the plunger in the force direction F, while coming into contact with reference to an external indication or triggering element, for example, a status indication or a micro switch.

The switching device according to the invention of the representative illustrations presupposes a cartridge-like shell 1, which preferably is made of a metal and thermally conductive material.

The cartridge-like shell 1 has a predominantly cylindrical shape and accommodates a plunger 3 in its interior.

The plunger 3 has a collar or a flange 5.

Between the flange 5 and a tapered portion 6 of the shell 1, a force-storage means, which is formed as a compression spring 2, can be provided.

The plunger 3 is arranged within the shell 1 transgressing through a first end-side opening 7 and is movable.

The movement path of the spring-loaded plunger 3 is limited by means of a fusible shaping part 4.

Figure 2:
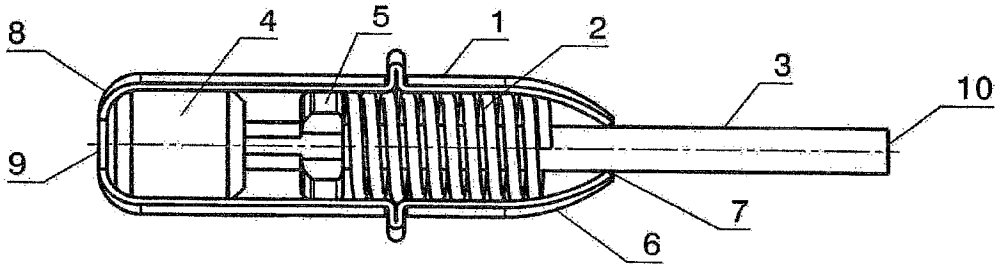
FIG. 2 shows an illustration similar to that of FIG. 1, but with a crimped shell end for fixing the solder shaping part and the remaining elements of the switching device.

The fusible shaping part 4 is provided at an end of the shell 1, which is located opposite to the first end-side opening 7. The fusible shaping part 4 is secured inside the shell 1 via a crimping 8 (see FIG. 2), wherein in the area of the crimping 8 a second opening 9 remains, which is located opposite the first end-side opening 7.

When the melting temperature of the fusible shaping part 4 is reached, the respective end of the plunger 3 displaces the molten mass of material. This leads to the plunger 3 moving to the left in the illustration according to FIG. 2 as a result of the preload force of the spring 2.

Thus, the locking effect of the fusible shaping part 4 is cancelled when it is heated and changes to the fluid phase.

Figure 3:
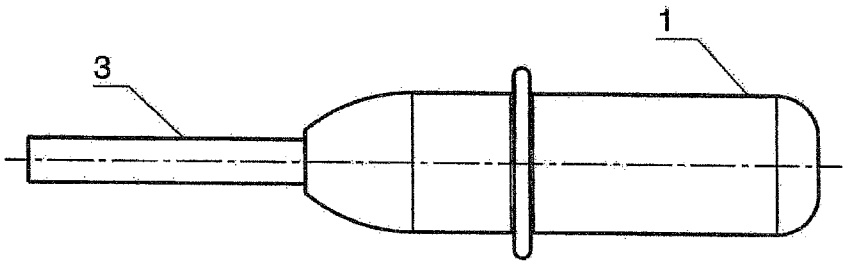
FIG. 3 shows an illustration of a switching device according to the invention, designed as a cartridge-shaped shell in the initial state, that is, before thermal heating.
Figure 4:
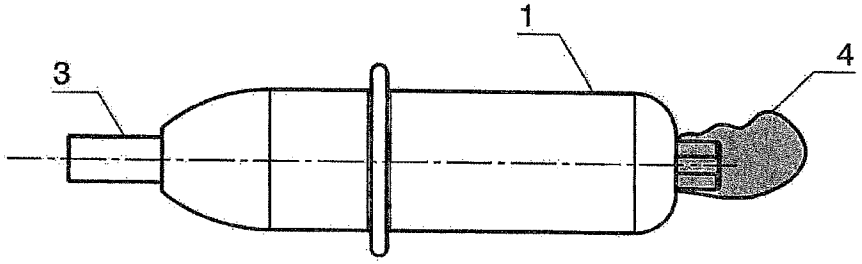
FIG. 4 shows an illustration similar to that of FIG. 3, but in a state after reaching the melting temperature of the fusible shaping part and successfully displacing the melted material out of the second opening along with a consequently changed position of the plunger.

The illustration of FIG. 3 shows the state with the solid fusible shaping part 4, while FIG. 4 shows how, over the course of the increase in temperature, the material of the fusible shaping part 4 passes through the second opening 9 and is practically displaced by the plunger 3, which in this case retreats into the interior of the shell 1, driven by the mentioned spring 2 and the operating spring force.

By means of the illustrations of FIGS. 5 and 6 it is to be exemplified that, depending on the state of the fusible shaping part 4 and the position of a free plunger end 10 resulting from this state, the plunger is able to trigger, for example, a micro switch 11, that is, to either block that switch (see FIG. 5) or release it (see FIG. 6).

Further there is the option that the plunger end 12, which has displaced the molten material of the shaping part 4, passes beyond the second opening 9 out of the shell 1 and triggers a micro switch or an indication unit 13 (see FIG. 6), which is released in the thermally non-activated state (see FIG. 5).

Figure 1:
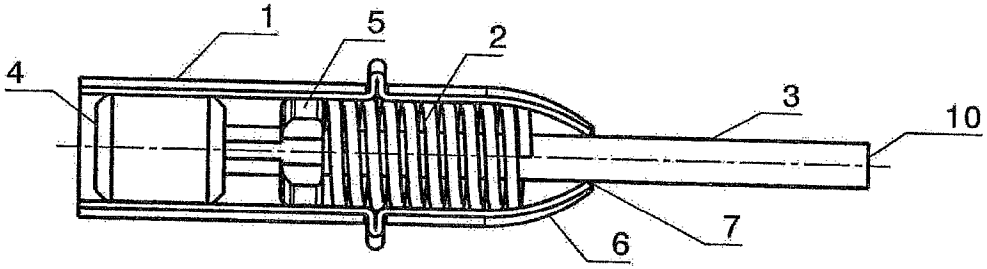

The shell 1 can be a preformed component, which is closed by crimping after accommodating the spring and plunger as well as installing the fusible shaping part or a solder shaping part. With installing the solder shaping part or the fusible shaping part 4 in the still open shell, as shown in FIG. 1, at the same time, a loading of the compression spring 2 can take place. The respective compression spring load is sustained in the result of crimping the shell 1 (see FIG. 2).

From the representative illustrations it is apparent that with heating, the fusible shaping part changes its aggregate state, wherein the plunger is triggered by means of the spring force, and the fusible shaping part material is displaced. From the change in position of the plunger, for example, a mechanical signal can be inferred or an electrical switch can be subject to triggering.

In the shown embodiment the plunger can be pulled into the shell on one side and at the same time can be pushed out of the shell via the mentioned second opening.

The emerging fluid solder, as shown in FIG. 4, can cause a contacting, for example, on a closely provided contact assembly, for example a circuit board.

The invention claimed is:

1. A thermally triggered, mechanical switching device, which comprises:

a fusible shaping part and a mechanical force-storage means, wherein the fusible shaping part blocks or unblocks the movement path of a (3), the plunger (3) having a first end and an oppositely disposed second end; the plunger (3) further being preloaded by the mechanical force-storage means, and a housing that accommodates the fusible shaping part, the plunger and the mechanical force-storage means, wherein the housing is designed as a cartridge-like shell (1), which receives the plunger (3) in the interior thereof, wherein said plunger is mounted in a movable manner through a first end-side opening (7) in the housing and is supported against the fusible shaping part (4) under pretension, wherein the fusible shaping part (4) is arranged so as to cover a second opening (9), which is located opposite the first end-side opening, in such a way that, when a melting temperature of the fusible shaping part (4) is reached, said fusible shaping part is displaced by the plunger (3) and the plunger (3) takes on a changed position;

wherein the plunger (3) is movable between a first position and a second position, the plunger (3) being in the first position if the melting temperature of the fusible shaping part (4) has not been reached, the plunger (3) moving to the second position if the melting temperature of the fusible shaping part (4) has been reached;

wherein in the first position, the first end of the plunger (3) protrudes from the first end-side opening (7) and is operatively coupled to a first electrical switch or a first switching status indicator; and wherein in the second position, the first end of the plunger (3) is operatively decoupled from the first electrical switch or the first switching status indicator.

2. The thermally triggered, mechanical switching device according to claim 1, characterized in that the plunger (3) is provided with a collar (5) or a flange, against which a coil spring (2) acts as the force-storage means is supported.

3. The thermally triggered, mechanical switching device according to claim 1, characterized in that the housing has a tapered portion (6) with a reduced diameter in the direction of the first end-side opening (7).

4. The thermally triggered, mechanical switching device according claim 3, characterized in that the force-storage means is supported against the tapered part (6) in the interior of the housing.

5. The thermally triggered, mechanical switching device according to claim 1, characterized in that the plunger (3), after displacing the fusible shaping part (4), is movable with the second end penetrating the second opening (9).

6. The thermally triggered, mechanical switching device according to claim 1, characterized in that the fusible shaping part (4) is designed as a plug with respect to the second opening (9), the plug being located inside the housing and designed to close the second opening.

7. The thermally triggered, mechanical switching device according to claim 1, characterized in that, the housing is made of a thermally conductive material, wherein the device's response behaviour is settable or adjustable via the thermal capacity of the housing in conjunction with the material of the fusible shaping part (4).

8. The thermally triggered, mechanical switching device according to claim 1, characterized in that, the fusible shaping part (4) is made of an electrically conductive solder material, wherein the displaced solder material causes an electrical switching mechanism.

9. The thermally triggered, mechanical switching device according to claim 1, wherein in the second position, the second end of the plunger protrudes from the second opening and is operatively coupled to a second electrical switch or a second switching status indicator.

10. A thermally triggered, mechanical switching device, which comprises:

a fusible shaping part (4) and a mechanical force-storage means, wherein the fusible shaping part (4) blocks or unblocks the movement path of a plunger (3), the plunger (3) having a first end and an oppositely disposed second end; the plunger (3) further being preloaded by the mechanical force-storage means, and a housing that accommodates the fusible shaping part (4), the plunger (3) and the mechanical force-storage means, wherein the housing is designed as a cartridge-like shell (1), which receives the plunger (3) in the interior thereof, wherein said plunger is mounted in a movable manner through a first end-side opening (7) in the housing and is supported against the fusible shaping part (4) under pretension, wherein the fusible shaping part (4) is arranged so as to cover a second opening (9), which is located opposite the first end-face opening, in such a way that, when a melting temperature of the fusible shaping part (4) is reached, said fusible shaping part is displaced by the plunger (3) and the plunger (3) takes on a changed position;

wherein the plunger (3) is movable between a first position and a second position, the plunger (3) being in the first position if the melting temperature of the fusible shaping part (4) has not been reached, the plunger moving to the second position if the melting temperature of the fusible shaping part has been reached;

wherein in the first position, the first end of the plunger protrudes from the first end-side opening; and wherein in the second position, the second end of the plunger protrudes from the second opening and is operatively coupled to an electrical switch or a switching status indicator.

* * * * *